US006017833A

United States Patent [19]

Reiner et al.

[11] Patent Number: 6,017,833

[45] Date of Patent: Jan. 25, 2000

[54] SPUNLACE MATERIAL WITH HIGH BULK AND HIGH ABSORPTION CAPACITY AND A METHOD FOR PRODUCING SUCH A MATERIAL

[75] Inventors: Lennart Reiner, Matfors; Ulf Holm, Göteborg, both of Sweden; Gerhard Lammers, RP Noordbergum, Netherlands

[73] Assignee: SCA Hygiene Paper AB, Gothenburg, Sweden

[21] Appl. No.: 08/894,061

[22] PCT Filed: Feb. 15, 1996

[86] PCT No.: PCT/SE96/00200

§ 371 Date: Oct. 14, 1997

§ 102(e) Date: Oct. 14, 1997

[87] PCT Pub. No.: WO96/25556

PCT Pub. Date: Aug. 22, 1996

[30] Foreign Application Priority Data

Feb. 17, 1997 [SE] Sweden ..... 9500585

[51] Int. Cl.[7] ..... D21H 11/00; D04H 1/46; D04H 1/48

[52] U.S. Cl. ..... 442/408; 162/141; 162/146; 162/158

[58] Field of Search ..... 442/408; 162/141, 162/146, 158

[56] References Cited

U.S. PATENT DOCUMENTS 5,607,546 3/1997 Höglund et al. .

FOREIGN PATENT DOCUMENTS

| | | |
|---|---|---|
| 841938 | 5/1970 | Canada . |
| 478 045 | 4/1992 | European Pat. Off. . |
| 492 554 | 7/1992 | European Pat. Off. . |
| WO 96/04066 | 4/1990 | WIPO . |
| WO 95/34711 | 12/1995 | WIPO . |
| WO 96/02701 | 2/1996 | WIPO . |
| WO 96/12849 | 5/1996 | WIPO . |

OTHER PUBLICATIONS

"Hydroentanglement Technology Applied to Wet–formed and Other Precursor Webs", *Tappi Journal*, Jun. 1990, C.F. White, pp. 187–192.

*Primary Examiner*—Blaine Copenheaver
*Assistant Examiner*—Cheryl Juska
*Attorney, Agent, or Firm*—Burns, Doane, Swecker & Mathis, L.L.P.

[57] ABSTRACT

Nonwoven material produced by hydro-entanglement of a wet- or foam-formed fibre web, which material contains at least 5%, by weight of the total fibre weight, of pulp fibres of chemical-thermomechanical type. These fibres have been mixed with other fibres, such as chemical pulp fibres, vegetable fibres, synthetic fibres or regenerated cellulosic fibres in a wet- or foam-formed fibre web which has been entangled with sufficient energy to produce a dense, absorbent material.

10 Claims, 1 Drawing Sheet

SPUNLACE MATERIAL WITH HIGH BULK AND HIGH ABSORPTION CAPACITY AND A METHOD FOR PRODUCING SUCH A MATERIAL

This application claims priority to International Application No. PCT/SE96/00200, filed Feb. 15, 1996.

BACKGROUND OF THE INVENTION

The present invention relates to a nonwoven material produced by hydro-entanglement of a wet- or foam-formed fibre web.

Hydro-entanglement or spunlacing is a method which was introduced in the 1970s, see for example Canadian patent no. 841,938. The method involves forming either a dry-laid or wet-laid fibre web, whereafter the fibres are entangled by means of very fine water jets under high pressure. A plurality of rows of water jets are directed towards the fibre web which is carried on a moving wire. The entangled web is thereafter dried. Those fibres which are used in the material can be synthetic or regenerated staple fibres, e.g. polyester, polyamide, polypropylene, rayon and the like, pulp fibres or a mixture of pulp fibres and staple fibres. Spunlace material can be produced to a high quality at reasonable cost and display high absorption capability. They are used inter alia as wiping materials for household or industrial applications, as disposable materials within health care, etc.

The pulp fibres used in spunlace materials are mainly chemically exposed softwood pulp from different kinds of wood. The use of chemically exposed hardwood pulp and pulp produced from recycled fibres is also described in the literature, see EP-A-0,492,554.

Chemical pulp is produced by impregnating wood chips with chemicals and by subsequent boiling of the chips so that lignin, resins and hemicellulose are transferred to the boiling liquid. When the boiling is completed, the pulp is filtered and washed before it is bleached. The lignin content of such pulp is very close to zero and the fibres, which essentially consist of pure cellulose, are relatively long and slender. The fibres show a certain degree of flexibility, which is an advantage when the fibres are entangled by the hydro-entanglement process. Furthermore, the cellulose in the fibres form hydrogen bonds, which increases the strength of the finished material. A high degree of hydrogen bonding of the material does, however, impair the softness and decrease the bulk of the material.

SUMMARY OF THE INVENTION

The object of the present invention is to produce a spunlace material which presents improved absorption properties, softness and bulk. In accordance with the invention, this is accomplished with a material containing at least 5%, by weight of the total fibre weight, of wood pulp of chemical-thermomechanical type which has been mixed with other fibres, such as chemical pulp fibres, vegetable fibres, synthetic fibres or regenerated cellulosic fibres in a wet- or foam-formed fibre web which has been hydro-entangled with sufficient energy to produce a dense absorbent material.

The proportion of pulp fibres of chemical-thermomechanical type should be at least 5 and preferably at least 10% by weight of the total fibre weight. The material may additionally contain a wet strength agent or a binding agent. The invention is also directed to a method for producing the nonwoven material in question.

DESCRIPTION OF THE INVENTION

Figure 1:
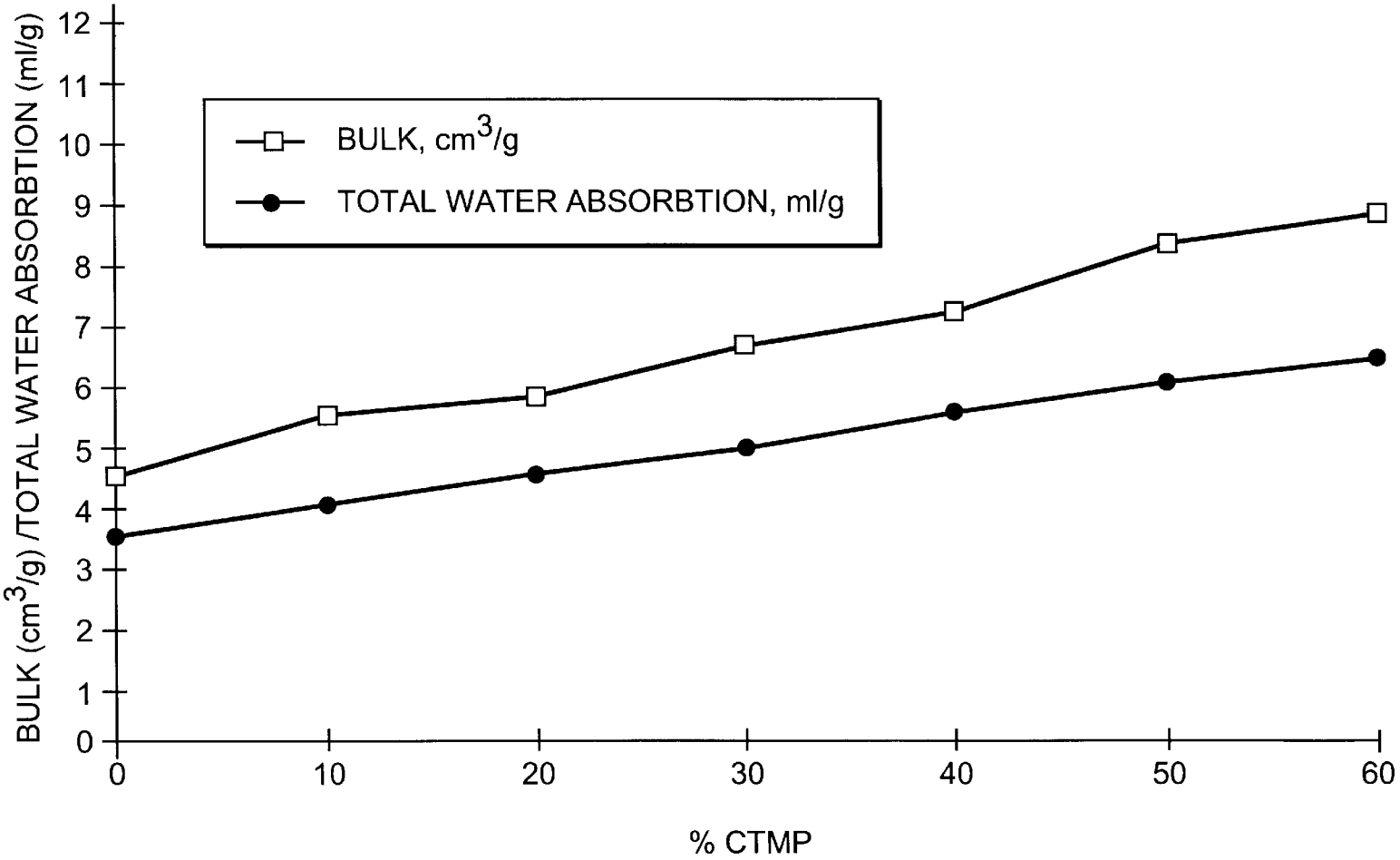
FIG. 1 shows in the form of a diagram the effect of the CTMP on the bulk and the total water absorption for some foam-formed spunlace materials.

The spunlace material according to the invention contains at least 5%, by weight of the total fibre weight, of pulp fibres of chemical-thermomechanical type.

Mechanical pulp is produced by grinding or refining and the principle for mechanical pulp production is to mechanically disintegrate the wood. All of the wood material is used and the lignin thus remains in the fibres, these being comparatively short and stiff. Production of thermomechanical pulp (TMP) is carried out by refining in a disc refiner at elevated steam pressure. Also in this instance the lignin remains in the fibres.

A thermomechanical pulp can be modified by addition of small amounts of chemicals, usually sulphite, which are added before the refining. Such pulp is referred to as chemical-mechanical pulp (CMP) or chemical-thermomechanical pulp (CTMP). A variant of CTMP is described in the International patent application PCT/SE91/00091 and in the Swedish patent application no.9402101-1, these pulps also being included in the invention. An effect of the chemical treatment is that the fibres are more readily exposed. A chemical-mechanical or chemical-thermomechanical pulp contains more unbroken fibres and less shives (fibre aggregates) than a mechanical or thermomechanical pulp. The properties of the chemical-mechanical or chemical-thermomechanical pulps are close to those of the chemical pulps, but some essential differences exist, i.a. due to the fact that the fibres in chemical-mechanical and chemical-thermomechanical pulp are coarser and contain a high proportion of lignin, resins and hemi-cellulose. The lignin gives the fibres more hydrophobic properties and a decreased ability to form hydrogen bonds.

These are properties which previously have not been considered desirable in the fibres used for production of spunlace materials, where flexible fibres, which easily hitch on to each other and are entangled into a strong material, have been sought.

It has now, surprisingly, been shown that by adding fibres of the above mentioned kind to a spunlace material, the absorption capacity, bulk and softness thereof will be considerably improved. The tensile strength of the material is indeed reduced, but will still be totally sufficient for a wide range of applications. The tensile strength can, however, been increased by the addition of a wet strength agent or a binding agent, preferably in an amount corresponding to between 0.1 and 10% by weight, and most preferably between 0.2 and 5% by weight calculated on the total weight of the material. Of the above mentioned pulps, the chemical-thermomechanical pulp (CTMP) is preferred.

Although the spunlace material may only contain fibres of the above mentioned kind, it preferably further contains other kinds of fibres, such as chemical pulp fibres, vegetable fibres, synthetic fibres and/or regenerated cellulosic fibres, i.e. viscose or rayon. In this manner, the tensile strength of the material is increased. Some examples of suitable synthetic fibres are polyester, polypropylene, and polyamide.

Examples of vegetable fibres which can be used are leaf fibres such as abaca, pineapple and phormium tenax, bast fibres such as flax, hemp and ramie and seed hair fibres such as cotton, kapok and milkweed. During the addition of such long hydrophillic vegetable fibres in wet- or foam-formed materials, it may be necessary to add a dispersion agent, for example a mixture of 75% bis(hydro-generated tallow-alkyl)dimethyl ammonium chloride and 25% propylene glycol. This is described in greater detail in Swedish patent application no.9403618-3.

The invention comprises wet- or foam-forming of a fibre web containing the desired fibre blend and dewatering of the web on a wire. By foam-forming, the fibres are dispersed in a foamed liquid containing a foam-forming surfactant and water, whereafter the fibre dispersion is dewatered on a wire in a manner corresponding to that used in connection with wet-forming. An example of a suitable such foam-forming process is found in Swedish patent application no. 9402470-0.

The fibre web formed in this manner is exposed to hydro-entanglement with an energy input which may suitably lie in the range of 200–800 kWh/ton. The hydro-entanglement is carried out by conventional techniques and using equipment supplied by machine manufacturers. Subsequent to the hydro-entanglement, the material is pressed and dried and is rolled up. The finished material is then converted by known methods into a suitable size, and is then packed.

Materials produced according to the invention have sufficiently good strength properties to enable them to be used as wiping materials, even in applications where comparatively high wet strengths are required. By addition of a suitable binding agent, or a wet strength agent, by impregnating, spraying, film application or other suitable method of application, the properties of the material can be further improved. The binding agent or wet strength agent can either be added to the hydro-entangled material, or to the fibre stock before wet- or foam-forming of the fibre web. The material may be used as wiping material for household purposes or for large quantity consumers such as workshops, industries, hospitals and other public establishments. Due to its softness it is also suitable as disposable material within the health care sector, for example operation gowns, drapes, and the like. Due to its high absorption capacity, it is further highly suitable as a component in absorption products such as sanitary napkins, panty liners, diapers, incontinence-products, bed protectors, wound dressings, compresses and the like.

EXAMPLE

Several different materials with different fibre composition and varying content of CTMP-fibres have been produced and tested, whereby a comparison has been made with a reference material not containing CTMP-fibres. The CTMP-fibres consisted of commercially available chemical-thermomechanical pulp produced from softwood. The chemical pulp fibres consisted of bleached chemical softwood pulp. The synthetic fibres that were used consisted of polyester of 1.7 dtex×12.7 mm and polypropylene 1.4 dtex×18 mm, respectively. Fibre webs were either produced by wet-forming or by foam-forming and were subsequently hydro-entangled with an energy input of about 600 kWh/ton, were slightly pressed and dried by through-blowing at 130°. The properties of the materials are presented below in Table 1, with the accompanying FIG. 1.

TABLE 1

| | MATERIAL | | | | | | | | | |
|---|---|---|---|---|---|---|---|---|---|---|
| | A-ref | A1 | B-ref | B1 | B2 | B3 | B4 | B5 | B6 | |
| FORMING METHOD | wet forming | wet forming | foam forming | foam forming | foam forming | foam forming | foam forming | foam forming | foam forming | |
| % CHEMICAL PULP FIBRE | 64 | 37 | 60 | 50 | 40 | 30 | 20 | 10 | 0 | 1) |
| % SOFTWOOD CTMP | 0 | 27 | 0 | 10 | 20 | 30 | 40 | 50 | 60 | 2) |
| % POLYESTER 1.7dtex* 12.7 mm | 36 | 36 | — | — | — | — | — | — | — | 3) |
| % POLYPROPYLENE 1.4dtex* 18 mm | — | — | 40 | 40 | 40 | 40 | 40 | 40 | 40 | 4) |
| ENTANGLEMENT ENERGY, KW/ton* | ≃600 | ≃600 | ≃600 | ≃600 | ≃600 | ≃600 | ≃600 | ≃600 | ≃600 | METHOD |
| PRESSING | light | light | light | light | light | light | light | light | light | |
| THROUGH AIR DRYING | 130° C. | 130° C. | 130° C. | 130° C. | 130° C. | 130° C. | 130° C. | 130° C. | 130° C. | |
| BASIS WEIGHT, g/m$^2$ | 82.6 | 78.5 | 92.1 | 81.6 | 81.6 | 79.0 | 79.5 | 74.2 | 75.6 | SCAN-P 6:75 |
| THICKNESS, $\mu$m | 363 | 427 | 419 | 446 | 474 | 525 | 573 | 616 | 664 | SCAN-P 47:83 |
| BULK, cm$^3$/g | 4.4 | 5.4 | 4.5 | 5.5 | 5.8 | 6.6 | 7.2 | 8.3 | 8.8 | thickness/basis weight |
| TENSILE STRENGTH L, N/m | 1840 | 1224 | 2997 | 2425 | 2391 | 2216 | 1989 | 1783 | 1645 | SCAN-P 38:80 |
| TENSILE STRENGTH C, N/m | 952 | 760 | 1837 | 1460 | 1215 | 1097 | 983 | 806 | 631 | SCAN-P 38:80 |
| ELONGATION L, % | 27 | 29 | 82 | 73 | 72 | 77 | 71 | 78 | 70 | SCAN-P 38:80 |
| ELONGATION C, % | 58 | 53 | 125 | 112 | 105 | 114 | 107 | 104 | 98 | SCAN-P 38:80 |
| WET TENSILE STRENGTH L, N/m | 656 | 342 | 2412 | 1937 | 1796 | 1275 | 1012 | 672 | 718 | SCAN-P 58:86 |
| WET TENSILE STRENGTH L, N/m | 428 | 246 | 1118 | 881 | 608 | 234 | 196 | 162 | 173 | SCAN-P 58:86 |
| TOTAL ABSORPTION | 3.6 | 4.3 | 3.5 | 4.0 | 4.5 | 4.9 | 5.5 | 6.0 | 6.4 | SIS 251228 |

*) Entanglement energy calculated on added quantity of fibre.
1) bleached chemical softwood pulp
2) commercially available chemical-thermomechanical pulp produced from softwood
3) commercially available polyester fibre for wet laid nonwoven
4) commercially available polypropylene fibre for wet laid nonwoven The results show that the bulk and the absorption capacity of the materials were notably increased with increasing admixture of CTMP-fibres. The materials were further perceived as being softer. The strength of the materials did, however, fall with increasing admixture of CTMP-fibres. For numerable applications, these strength values are, however, totally sufficient and as mentioned above, the tensile strength can be increased by addition of a wet strength agent or a binding agent, preferably in an amount corresponding to between 0.1 and 10% by weight, and most preferably between 0.2 and 5% by weight calculated on the total weight of the material.

We claim:

1. Nonwoven material produced by hydro-entanglement of a wet- or foam-formed fibre web, said material comprising:

at least five percent, by weight of the total fibre weight, of chemical thermomechanical pulp fibres of said fibres having been mixed with other fibres, selected from the group consisting of chemical pulp fibres, vegetable fibres, synthetic fibres and regenerated cellulosic fibres, in a wet- or foam-formed fibre web which has been entangled with sufficient energy to produce a dense, absorbent material.

2. Nonwoven material according to claim 1, wherein a proportion of chemical thermomechanical pulp fibers is at least ten percent by weight of the total fibre weight.

3. Nonwoven material according to claim 1, wherein the material contains a wet strength agent or a binding agent.

4. Nonwoven material according claim 3, wherein a proportion of wet strength agent or binding agent amounts to between 0.1 and 10% by weight.

5. Method for producing a nonwoven material according to claim 1, said method comprising the steps of forming a fibre web by wet- or foam-forming, containing at least five percent, by weight of the total fibre weight, of chemical-thermomechanical pulp fibres, subjecting the fibre web to hydro-entanglement, thereby forming a dense, absorbent material of entangled fibres, and thereafter drying the material.

6. Method according to claim 5, wherein a proportion of chemical-thermomechanical pulp fibers is at least ten percent by weight of the total fibre weight.

7. Method according to claim 5, wherein in connection with the hydro-entanglement, a wet strength agent or a binding agent is added by spraying, impregnating, or coating.

8. Method according to claim 5, wherein a wet strength agent or a binding agent is added to the fibres before the wet- or foam-forming of the fibre web.

9. Nonwoven material according claim 3, wherein the proportion of wet strength agent or binding agent amounts to between 0.2 and 5% by weight.

10. Nonwoven material according to claim 1, wherein a proportion of chemical-thermomechanical pulp fibers is no more than 60% by weight of the total fiber weight.

* * * * *